US007503200B2

(12) United States Patent
Gerritsen et al.

(10) Patent No.: US 7,503,200 B2
(45) Date of Patent: Mar. 17, 2009

(54) METHOD FOR CORRECTING A FOLDING OPERATION AND FOLDING PRESS

(75) Inventors: Gerrit Gerritsen, Cuarnens (CH); Piero Papi, Cheseaux (CH)

(73) Assignee: Bystronic Laser AG, Niederönz (CH)

( * ) Notice: Subject to any disclaimer, the term of this patent is extended or adjusted under 35 U.S.C. 154(b) by 0 days.

(21) Appl. No.: 10/546,909

(22) PCT Filed: Feb. 19, 2004

(86) PCT No.: PCT/CH2004/000090

§ 371 (c)(1),
(2), (4) Date: Jun. 5, 2006

(87) PCT Pub. No.: WO2004/076161

PCT Pub. Date: Sep. 10, 2004

(65) Prior Publication Data

US 2007/0033981 A1 Feb. 15, 2007

(30) Foreign Application Priority Data

Feb. 26, 2003 (EP) ..... 03405126

(51) Int. Cl.
*B31D 5/02* (2006.01)
*B30B 15/24* (2006.01)

(52) U.S. Cl. ..... 72/389.5; 72/389.3; 72/31.11; 72/21.5; 72/702; 72/389.6; 100/99; 100/258 A

(58) Field of Classification Search ..... 72/17.3, 72/21.5, 31.11, 389.3, 389.4, 389.5, 389.6, 72/702; 100/46, 99, 258 R, 258 A
See application file for complete search history.

(56) References Cited

U.S. PATENT DOCUMENTS

| | | | | |
|---|---|---|---|---|
| 4,408,471 | A | 10/1983 | Gossard et al. | |
| 5,193,452 | A | 3/1993 | Dieperink | |
| 5,329,795 | A * | 7/1994 | Sartorio et al. | 72/21.4 |
| 5,857,366 | A * | 1/1999 | Koyama | 72/31.1 |
| 6,401,512 | B1 * | 6/2002 | Gascoin | 72/389.5 |
| 6,519,996 | B1 * | 2/2003 | Gasparini | 72/389.5 |
| 6,871,521 | B2 * | 3/2005 | Sperrer | 72/21.1 |
| 2001/0009106 | A1 | 7/2001 | Gerritsen | |

FOREIGN PATENT DOCUMENTS

| | | |
|---|---|---|
| CH | 653289 A5 | 12/1985 |
| EP | 0540476 A | 5/1993 |
| WO | WO 91/03371 | 3/1991 |

* cited by examiner

*Primary Examiner*—David B Jones
(74) *Attorney, Agent, or Firm*—Clifford W. Browning; Krieg DeVault LLP

(57) ABSTRACT

Method of correcting a bending operation performed by a press brake, the bottom beam of which contains deformation compensation cylinders, in which a calibration nomogram is pre-recorded using very short calibration pieces, this nomogram establishing a correspondence between the forces measured at the side frames and the pressures applicable to the compensation cylinders in order to keep the bottom beam substantially straight. During a subsequent bending operation, pressure values resulting from this nomogram are applied to the compensation cylinders according to the forces measured at the side frames. A bottom dead center is recalculated by taking account of the deformation of the top beam, the deformation of the side frames, the actual length and thickness of the piece, and the spring effect.

19 Claims, 6 Drawing Sheets

METHOD FOR CORRECTING A FOLDING OPERATION AND FOLDING PRESS

Figure 1A:
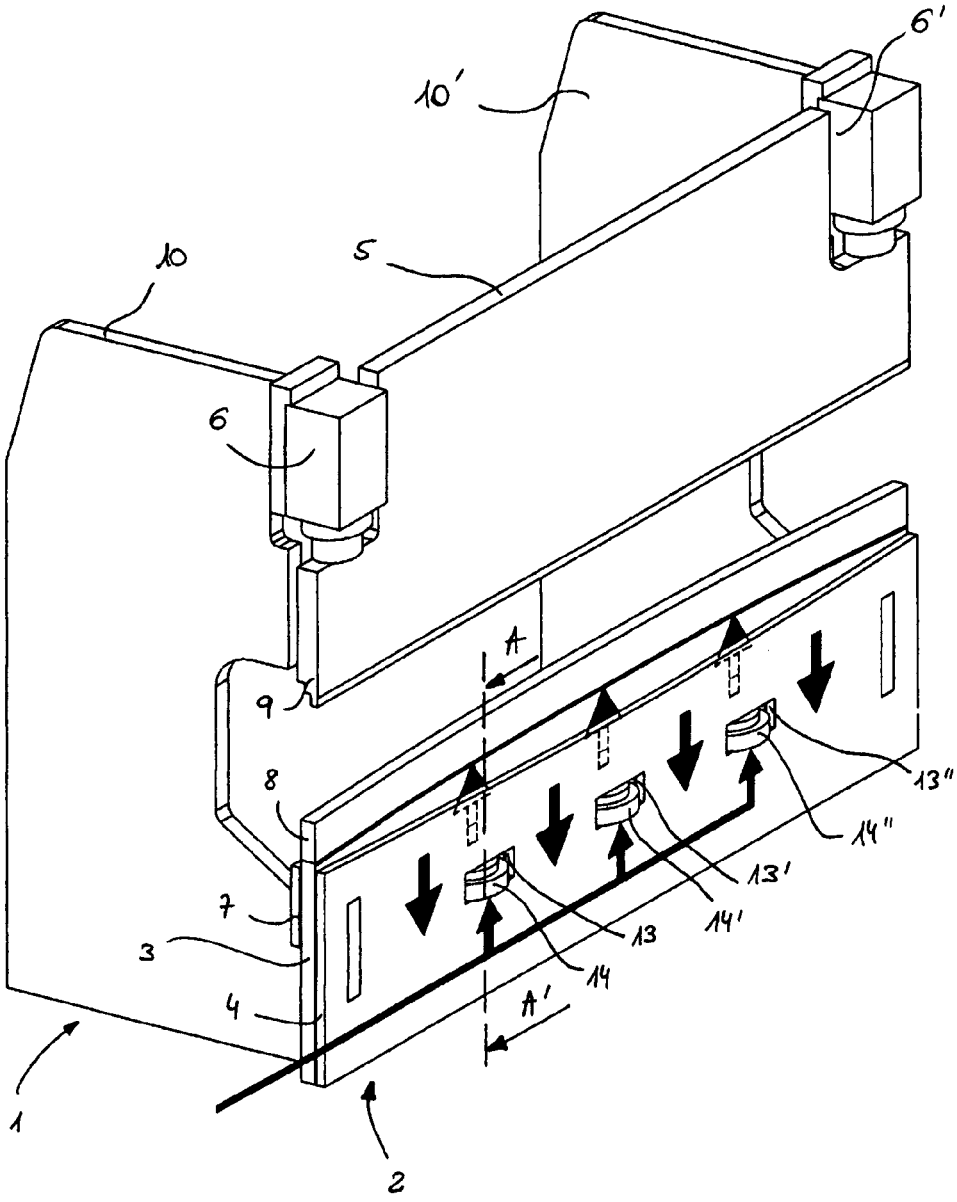

Applicant claims foreign priority benefits under 35 U.S.C. §§119 (a)-(d) or (f), or §365 (b) of European Patent Application No. 03405126.8, filed Feb. 26, 2003.

The present invention concerns a method of correcting a bending operation performed by a press brake of the type comprising a fixed beam, a movable beam, displacement means for displacing the movable beam resting on two side frames integral with the fixed beam, sensors, associated respectively with the two side frames, measuring the forces exerted by the said displacement means on the said side frames, deformation compensation cylinders associated with one of the two beams, and an electronic control device controlling the displacement of the movable beam between a top dead centre and a bottom dead centre.

The invention also concerns a press brake of this type.

The patent CH 653289 of the applicant describes a hydraulic press comprising a fixed beam and a movable beam and which comprises, inside a slot in the fixed beam, cylinders for compensating for the deformations occurring during the working of the press. A central control unit receives the information for means of measuring deformations and actuates the compensation cylinders so that, during the working phase, the two tools have the same curvature and remain parallel.

The document WO 91/03371 describes measuring means adapted to this type of hydraulic press, consisting of two longitudinal bars allocated respectively to each of the top and bottom beams. One of the ends of each of the bars is firmly fixed to the associated beam, whilst the other end, free, acts on an inductive sensor so that to compare the respective flexings of the two beams. The control unit actuates the compensation cylinders until there is compensation for the difference in flexing in the top beam and bottom beam, so that the tools remain parallel.

The use of such a correction method in such press substantially reduces the difference in bending angle between the middle and the ends of long pieces. On the other hand, the two beams and the tools certainly being parallel, but having a deflection, this deflection is transmitted to the piece to be bent, so that its edge is no longer perfectly straight, but curved. The method is ill-suited to the bending of short pieces, that is to say pieces with lengths very much less than the distance between the side frames.

The document CH 686119 of the applicant also describes a press brake of the type mentioned at the beginning. The electronic control device takes account of the respective measurements of the forces exerted on the two side frames in order to determine the pressures of the compensation cylinders so that the two tools have the same curvature and remain parallel in the area occupied by the piece being bent. Taking account of the difference between the forces exerted on the two side frames makes it possible to refine this deflection compensation mode for short pieces positioned off centre in the machine, but does not eliminate the defects mentioned above.

The document CH 653289 also describes another type of hydraulic press, in which both the fixed beam and the movable beam are provided with compensation cylinders. In such a machine, it is in principle possible, by means of the compensation cylinders, not only to make the two beams parallel but also to return both the die holder and the punch holder each to a straight line, parallel to each other. However, such a machine is more expensive to produce, since it must have two opposing series of compensation cylinders, one for each beam. In addition, programming an effective opposing use of the two series of compensation cylinders is very difficult and the functioning of such machines is not reliable. They have not met with success in practice.

The aim of the invention is therefore to propose a simple and effective method of correcting the bending operation or operations, which can be implemented automatically by the numeric control of a press equipped with a single row of compensation cylinders.

This aim is achieved by implementing, in a press brake of the type defined at the beginning, a method comprising the pre-recording of a calibration nomogram in the memory of the electronic control device, using very short calibration pieces, the said nomogram establishing a correspondence between the forces measured by the sensors associated with the side frames and the pressures that can be applied to the compensation cylinders of the beam carrying them, in order to keep the said beams substantially straight, and in which method, during a subsequent bending operation, pressures resulting from the said nomogram are applied to the said compensation cylinders, according to the forces measured at the said sensors.

Preferably, to the compensation for the deformation of the beams by means of the compensation cylinders, the correction method according to the invention adds a correction of the penetration depth of the punch into the die, by recalculating the bottom dead centre according to the characteristics of the piece to be bent and the values measured by the sensors associated with the side frames.

The method of calculating the correction to the bottom dead centre preferably takes account of the fact that the piece to be bent is a long piece or a short piece. "Long" piece means a piece with length substantially equal to the distance between the two side frames of the press. "Short" piece means a piece whose length does not exceed one third of the distance between the two side frames.

For a short piece, the correction to the bottom dead centre ΔZ can be calculated from the formula $$\Delta Z=\Delta f_{max}=(F.l^2{}_a.l^2{}_b)/(3.E.I.l)$$

in which:

F is the local load on the short piece (in newtons)

l is the distance between the side frames $l_a$ and $l_b$ are the respective distances from the centre of the piece to the side frames E is the modulus of elasticity of the top beam (in $N/mm^2$)

I is axial moment of inertia of the beam (in $mm^4$)

The deformation Δf of the beam which does not have any compensation cylinders increases during the elastic deformation phase of the bent piece but varies little during the plastic deformation phase.

The bottom dead centre is corrected by the value of the maximum deformation Δfmax of the beam.

For a long piece, it is possible to apply a correction to the bottom dead centre to the travel of the movable beam calculated by the formula $$\Delta Z'=\Delta f_{max}=(5.Q.l^4)/(384{,}000.E.I)$$

where Q designates the load per unit length of the piece (in N/m).

If the exact length of the piece to be bent is known, the type of correction to the bottom dead centre can be chosen by the machine operator, and the value of the length of the piece entered in the memory of the control electronics. If the length of the piece is not perfectly known, in particular if it varies from one piece to another in a series, it can be determined during operation, by reference to a first reference bending operation, and the correction will be determined automatically by the control electronics.

Figure 1B:
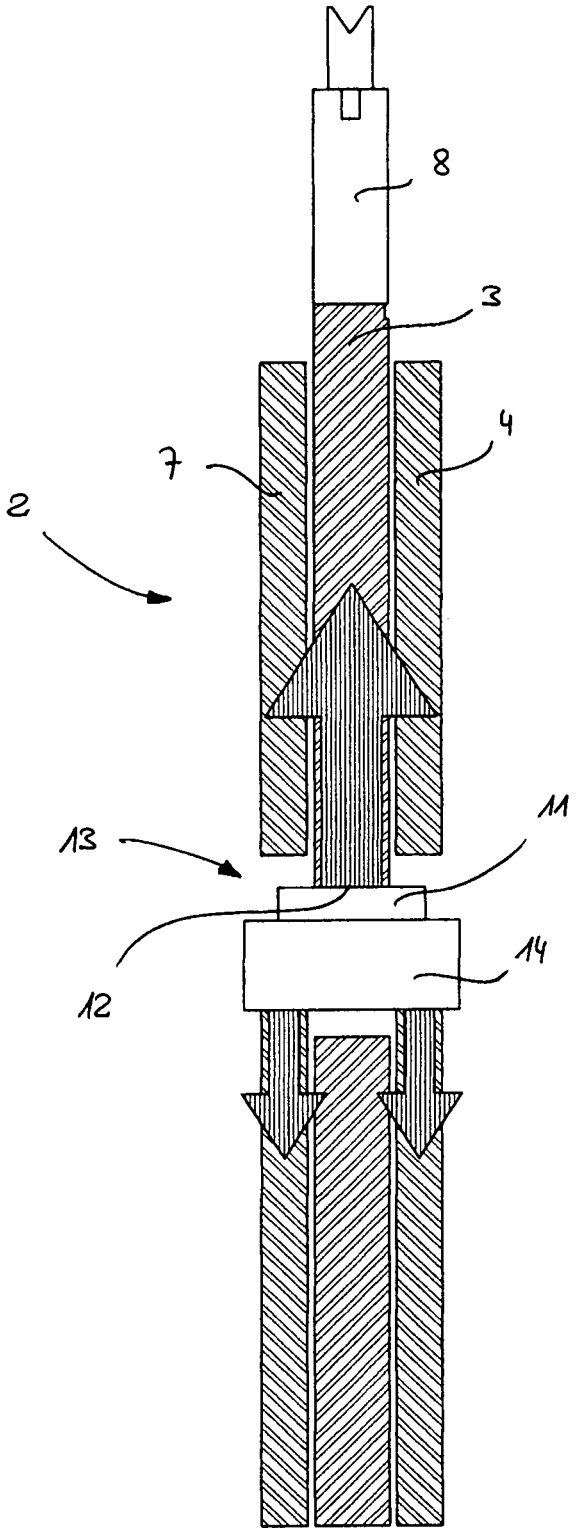

Other particularities and advantages of the invention will become clear to a person skilled in the art from the following description of an embodiment of the invention, referring to the figures, in which:

FIG. 1*a* is a schematic perspective view of a hydraulic press, showing the action of hydraulic compensation cylinders on the bottom beam;

FIG. 1*b* is a schematic view in transverse section of the bottom beam of the press in FIG. 1*a;*

Figure 2B:
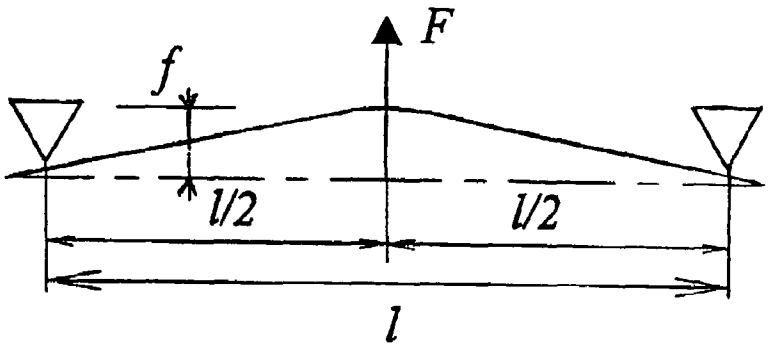
Figure 2A:
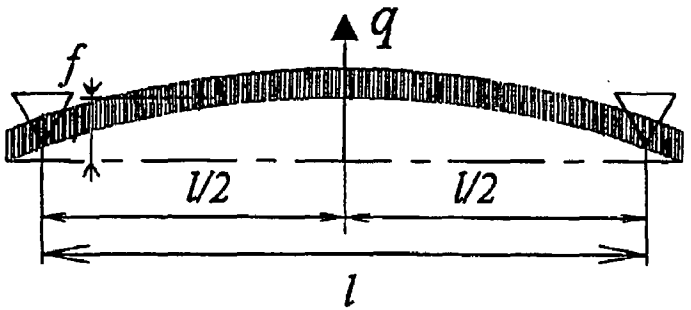
Figure 2C:
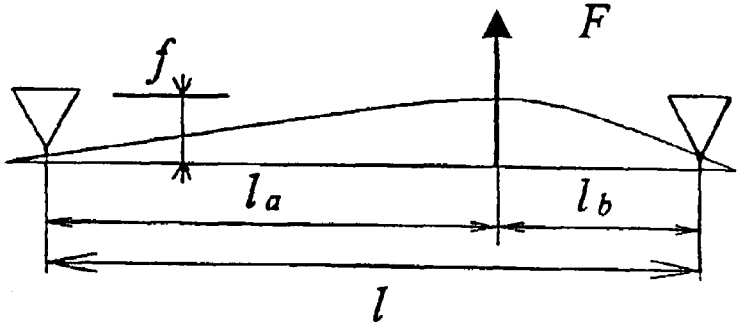

FIGS. 2*a*, 2*b* and 2*c* are schematic representations illustrating the resultant of the forces and the deformations of the beams, namely:

FIG. 2*a* is a representation of the bending of a long piece;

FIG. 2*b* is a representation of the bending of a short piece centred with respect to the side frames of the press;

FIG. 2*c* is a representation of the bending of a short piece, off centre with respect to the side frames of the press.

Figure 3A:
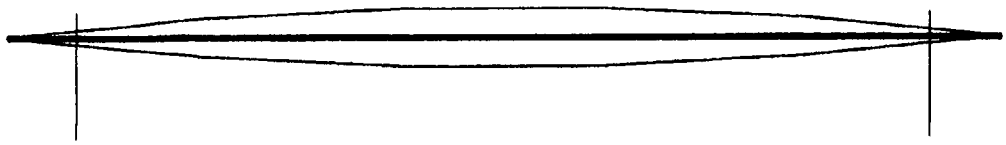
Figure 3B:
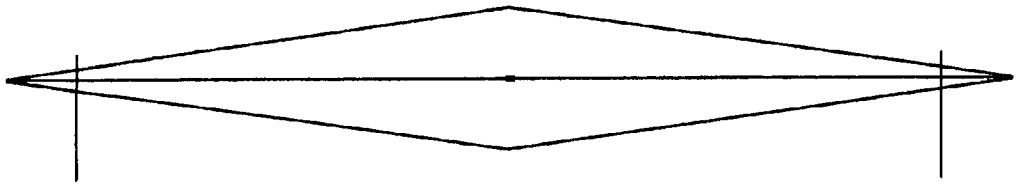
Figure 3C:
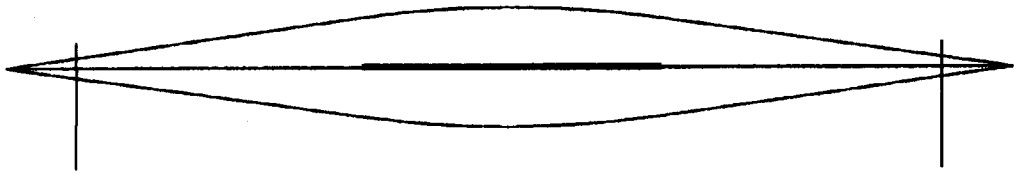

FIGS. 3*a*, 3*b* and 3*c* are schematic representations illustrating the deformations of the beams in the case of a bending operation without any correction to the flexing of the beams, namely:

FIG. 3*a* is a representation of a bending of a long piece;

FIG. 3*b* is a representation of a bending of a very short piece;

FIG. 3*c* is a representation of a bending of a short piece.

Figure 5B:
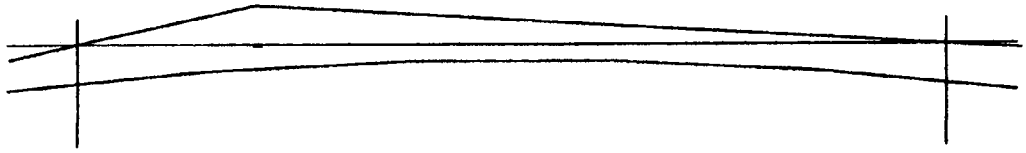
Figure 5C:
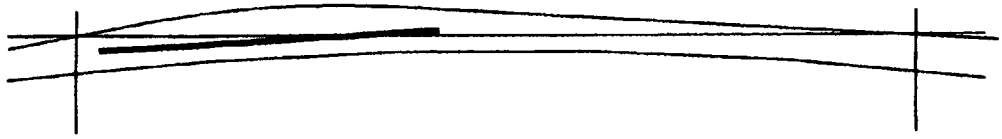
Figure 4A:
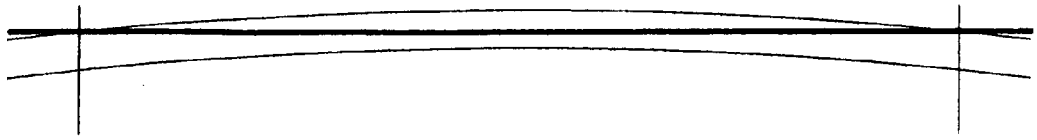
Figure 4B:
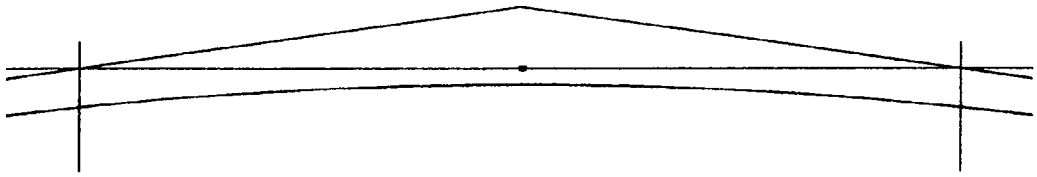
Figure 4C:
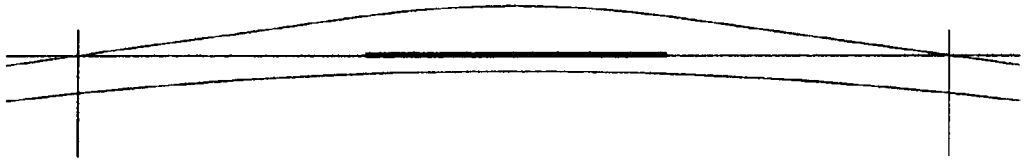

FIGS. 4*a*, 4*b*, 4*c*, 5*b* and 5*c* are schematic representations illustrating the deformations of the beams during a bending operation where only the flexing of the beams is compensated for, namely:

FIG. 4*a* is a representation of a bending of a long piece;

FIG. 4*b* is a representation of a bending of a centred very short piece;

FIG. 4*c* is a representation of a bending of a centred short piece;

FIG. 5*b* is a representation of a bending of an off-centre very short piece;

FIG. 5*c* is a representation of a bending of an off-centre short piece.

FIGS. 6*a*, 6*b*, 6*c*, 7*b* and 7*c* are schematic representations illustrating the deformations of the beams during a bending operation, of the same pieces as in the case of FIGS. 4*a* to 5*c*, where simultaneously the flexing of the beam and the bottom dead centre are corrected.

FIG. 1*a* shows a hydraulic press 1 with a top movable beam 5, the movement of which is effected under the action of the pistons and cylinders 6, 6' associated with the lateral side frames 10, 10'. During the bending of a piece, the movable beam 5 has a tendency to curve under the action of these pistons, the middle of the movable beam 5 then being situated higher than the two ends. Conversely, in the absence of a compensation device, the fixed bottom beam 2 would have a tendency to curve so that the middle of this fixed beam would be situated lower than the two ends. Under these conditions, the working surfaces of the two beams 2 and 5, and consequently the surfaces of the two tool holders, namely the die holder 8 and the punch holder 9, would no longer be parallel.

As shown by FIGS. 1*a* and 1*b*, the bottom beam 2 comprises a central plate 3 which carries the die holder 8. The central plate 3 is surrounded on each side by two reaction plates 4 and 7. The lateral ends of the central plate 3 and of the reaction plates 4 and 7 are fixed respectively to the side frames 10 and 10'.

The bottom beam 2 of the press depicted in FIG. 1*a* comprises three reaction holes 13, 13', 13", passing right through the plates 3, 4 and 7. Each reaction hole houses a hydraulic compensation cylinder 14, 14', 14", which rests on the reaction plates 4 and 7 and whose piston 11 bears below at 12 on the central plate 3, as illustrated schematically by FIG. 1*b*, in order to provide a compensation thrust to the top part of the central plate 3 of the bottom beam, so as to compensate for the deformation mentioned previously. As illustrated by FIGS. 1*a* and 1*b*, the reactions plates 4 and 7 undergo a downward reaction. The action of the hydraulic compensation cylinders 14, 14', 14" is controlled, like that of the pistons and working cylinders 6 and 6', by an electronic control unit (not shown in the drawing). On very long presses, the number of reaction holes provided with compensation cylinders is higher.

The invention applies both to this type of machine having several reaction holes and to those having a single compensation slot, described for example in CH 653289.

FIG. 2*c* illustrates schematically the curvature of the top beam during an operation of bending a piece whose length L is relatively short compared with the distance between the two side frames on the press. During this operation, the compensation cylinders act on the bottom beam so that its top edge remains substantially straight. In FIG. 2*c*, $\mathbf{1}_a$ and $\mathbf{1}_b$ designate respectively the distances from the centre of the piece being bent to each of the two side frames. The resultant F of the reactions of the piece towards the beam, which corresponds to the load on the piece, is applied substantially at the centre of the piece to be bent. The sensors associated with the two side frames measure respectively forces $F_a$ and $F_b$, such that $$F=F_a+F_b$$

$$\text{and } F_a=F.l_b/l$$

$$\text{and } F_b=F.l_a/l$$

In the hypothetical case where the centre of the piece to be bent is practically under the side frame a, $F_a$ would be practically equal to 100% of F, and $F_b \cong 0$.

In the case illustrated by FIG. 2*b*, where the piece is perfectly centred on the bottom beam, la=lb=l/2 and $F_a=F_b=50\%$ of F.

In a first step of the method, a valid calibration is carried out for a pair of beams, a pair of tool holders and tools. The calibration operation is performed by means of very short calibration pieces, that is to say ones whose length is less than 10% of the length between two cylinders, placed at several successive positions between the two side frames. The very short piece is put under pressure between the two beams and, for a succession of values of $F_a$ and $F_b$ along $l_a/l_b$, the cylinders of the bottom beam are adjusted so that its top edge is straight. All the values of $F_a$, $F_b$ and the values of the pressure of the compensation cylinders thus measured constitute a calibration nomogram, which is pre-recorded in the memory of the electronic control device.

During an actual bending operation on a piece which is relatively short compared with the distance l between the two side frames, the sensors of the two side frames measure forces $F_a$ and $F_b$ during bending and the electronic control device actuates the compensation cylinders so that their pressures correspond to the corresponding values of the nomogram.

A person skilled in the art will easily understand that, by actuating the compensation cylinders in the manner indicated above, the bottom beam remains substantially straight during the operation of bending short pieces, but has a certain residual curvature when bending long pieces.

As can be seen in FIG. 2*c*, the area of the top beam in contact with the piece being bent is not at the same height as the ends of the beam, at the two side frames; the difference in height, that is to say the deformation Δf, is given by the expression:

$$\Delta f = \frac{F \cdot 1_a^2 \cdot 1_b^2}{3 \cdot E \cdot I \cdot 1}$$

In which E is the modulus of elasticity (in $Nn/mm^2$) of the top beam and I designates the axial moment of inertia (in $mm^4$) of the beam. The values of E and I are determined when the beam is manufactured and are recorded in the memory of the control electronics.

Where the piece is centred in the press, this formula is simplified as:

$$\Delta f = \frac{F \cdot 1^3}{48 \cdot E \cdot I}$$

FIG. 2*a* illustrates the operation of bending a long piece. Under these conditions, the compensation cylinders being actuated as indicated before, the top beam undergoes a reaction Q, during the bending operation, whose distribution is substantially homogeneous, as illustrated by FIG. 2*a*. The deformation Δf of the top beam is given by the equation $$\Delta f = \frac{5 \cdot Q \cdot 1^4}{384{,}000 \cdot E \cdot I}$$

with the notations defined previously.

After calculation of the deformation Δfmax of the top beam, the depth of penetration of the tool into the die is corrected by correcting the position of the bottom dead centre by a quantity corresponding to the maximum deformation.

When the force sensors have detected an off-centre position of the piece, as illustrated in FIG. 2*c*, the correction applied may be different for the two side frames.

In a variant, the corrections to ΔZ may be entirely determined by means of digitised nomograms, pre-recorded in the memory of the electronic control device: for each bending angle of set values and for each ratio $1_a/1_b$, the nomogram contains corrections to the values ΔZ for each side frames, values which may vary from a few 100ths of a millimeter up to approximately 2 mm. The values of the corrections ΔZ applied to the two side frames are precalculated by means of formulae such as the formulae above. The values of the correction applicable are chosen by the electronic control device from values picked up by the pressure sensors associated with each of the two side frames. This method has the advantage of being much more rapid to implement during a bending operation than if the electronic system were to recalculate the corrections ΔZ in real time.

FIGS. 3*a* to 7*c* illustrate the advantages of the invention compared with the state of the art:

FIGS. 3*a*, 3*b* and 3*c* illustrate bendings without any compensation for the flexing of the beams:

FIG. 3*a* shows the bending of a piece whose length is approximately equal to that of the press brake: the bending angle at the middle of the piece is greater than the bending angle at the two ends.

FIG. 3*b* shows the bending of a very short piece: the angle is much more open than the set angle, because of the almost triangular deformation of the top and bottom side frames.

FIG. 3*c* shows the bending of a piece whose length is approximately one third of the length of the machine: the bending angle is relatively constant over the length of the piece but is appreciably more open than the set angle.

FIGS. 4*a*, 4*b*, 4*c* as well as 5*b* and 5*c* illustrate bendings in which only the flexing of the beams is compensated for so that these beams remain parallel during the bending of a long piece:

FIG. 4*a* depicts the bending of a long piece: the angle is constant over the entire length of the piece and is equal to the set value;

FIG. 4*b* depicts the bending of a centred very short piece: the angle is appreciably more open than the estimated angle because of the almost triangular deformation of the top beam.

FIG. 5*b* depicts the bending of the same piece, but off centre: the bending angle is also more open than the set value but in addition its value is variable according to the position of the piece on the machine, so that it may be difficult to carry out a correction to this angle in a reproducible manner.

FIG. 4*c* depicts the bending of a short piece whose length is approximately one third of the length of the machine: the angle is relatively constant along the piece but more open than the set value;

FIG. 5*c* illustrates the bending of the same piece greatly off centre: the bending angle is not constant, it is more open than the set value and corrections are very difficult to estimate.

FIGS. 6*a* to 7*c* illustrates bendings in which a correction to the bottom dead centres of the side frames of the top beam is superimposed on a compensation for the flexing of the bottom beam.

Figure 6A:
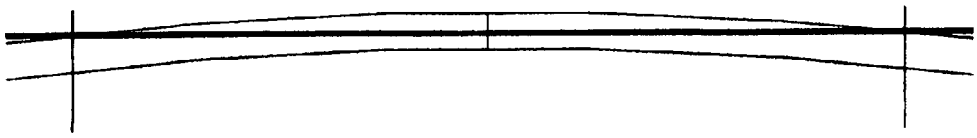

FIG. 6*a* shows the bending of a long piece: the angle is constant over the entire length of the piece and equal to the set value.

Figure 6B:
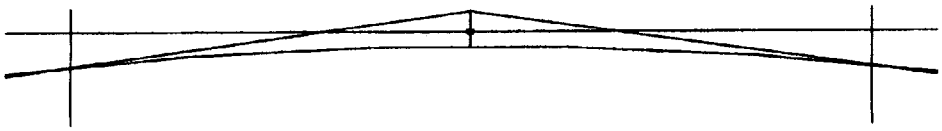

FIG. 6*b* shows the bending of a centred very short piece: the two bottom dead centres of the two ends of the top beam are corrected for the almost triangular deformation of this and the value of the bending angle is correct.

Figure 7B:
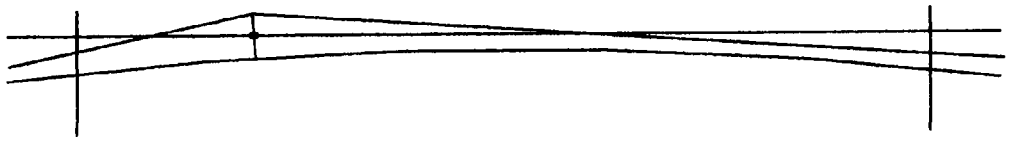

FIG. 7*b* shows the bending of the same off-centre piece: the two bottom dead centres of the two ends of the top beam have undergone two different corrections adapted to correct the asymmetric triangular deformation of this beam and the bending angle of the very short piece is correct.

Figure 6C:
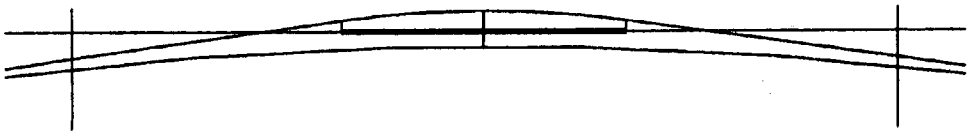

FIG. 6*c* shows the bending of a piece whose length is approximately one third of the length of the machine, centred: the two bottom dead centres of the two ends of the top beam have received the same correction and the bending angle has a substantially constant value over the length of the piece and equal to the set value.

Figure 7C:
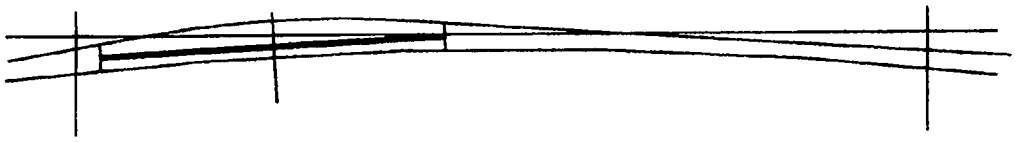

FIG. 7*c* illustrates the bending of the same off-centre piece in the machine: the two bottom dead centres of the ends of the top beam have received different corrections adapted so that the bending angle is approximately constant over the length of the piece and equal to the set value.

Several other phenomena may require corrections to the bottom dead centre of the machine, corrections which are added to the correction due to the beam deformations described above.

Thus, when a piece is bent, the force to which the side frames are subjected under the effect of the thrust of the cylinders causes a flexing of these side frames, which may result in a deformation of the frame of around 1 to 2 mm, which modifies the depth of penetration of the punch into the die. Several methods of correcting the deformation of the side frames are known in the prior art. It is for example possible to use the one described in the patent CH 680619 of the applicant: the force undergone by each of the side frames is determined by means of the pressure sensors associated with the working cylinders and the values obtained are compared with a nomogram establishing the relationship between the force undergone by each of the side frames and the flexing of the side frame, this nomogram being obtained during an initial operation of calibration of the press.

Another parameter liable to give rise to an error in the bending angle is the variability in the thickness of the pieces being processed. This is because the steel sheets supplied by the manufacturers may exhibit variations in thickness ranging up to ±10% of the nominal value. A precise bending operation must take into account the difference between the actual thickness of the piece and the nominal thickness. Several methods have been proposed for doing this in the prior art. It is for example possible to use the one described in patent number EP 1120176 of the applicant, according to which this difference is calculated by comparing the position of the displacement of the movable beam, at which there occurs a predetermined variation in the pressure recorded by the sensors associated with the working cylinders, with the theoretical position of the beam where this variation should occur if the thickness of the piece were strictly equal to its nominal thickness. The position of the bottom dead centre is corrected during the bending operation by the electronic control device when this measurement has been made.

Another problem which is posed during a bending process is the compensation for the spring effect, that is to say the elastic return of the piece bent at a slightly smaller bending angle, when the pressure of the punch is released. Because of this effect, the maximum value of the instantaneous bending angle under load must be greater than the set value of the required bending angle, after release of the bent piece. Several methods of correcting the elastic return effect have been proposed in the prior art. It is for example possible to use the methods proposed by the patents U.S. Pat. No. 4,408,471 or U.S. Pat. No. 4,511,976 which determine the actual modulus of elasticity of the piece from data recorded during the elastic deformation phase of the bending process and which determine a correction to the bending angle by extrapolating the process on the basis of modelling.

It is also possible to calculate the compensation for the spring effect without carrying out possibly inadequate modelling using the method proposed by the applicant in its patent application number PCT/CH 02/00154, which determines the correction by comparing the data recorded during the plastic phase of the deformation of the piece with the data collected during a first bending trial which serves as a reference. In this method, the compensation for the spring effect is deduced from the difference between the data measured during the bending operation and during the reference operation, without extrapolation and without modelling.

Finally, it is possible to carry out a correction for taking account of the variations in length of the pieces to be bent and, to do this, it is possible first of all to proceed with a calibration bending operation with a piece whose exact length is known, whilst measuring the actual thickness, as indicated above. During the calibration bending operation, for a given angle, for example 150°, the pressing force necessary for this bending is measured. The exact length of this piece being known, the control unit can calculate the force per unit length, for example in t/m. For the subsequent bendings in the series, the pressing force is measured at this same angle, for example 150°, and this force is compared with that recorded during the first calibration operation. The actual length of the successive pieces can then be determined by applying a simple proportionality rule, with an approximation of ±10 mm, which is sufficient in practice.

According to another variant, in determining the actual length of the piece, it is possible to accept that the tensile strength is constant and corresponds to the nominal value. The length of the piece can be deduced from the equation $$\frac{F}{L} = \frac{e^2 \cdot \gamma \cdot 1{,}75}{V}$$

in which:

e designates the measured thickness

γ designates the tensile strength

V is the angle

F is the force in tonnes

L is the length of the piece

All the aforementioned corrections make it possible to recalculate the bottom dead centre of the travel of the top beam whilst a bending operation is underway.

The invention claimed is:

1. A method of correcting a bending operation performed by a press brake comprising the steps of providing two side frames integral with a fixed beam, a movable beam, and with displacement means for displacing the movable beam resting on said two side frames, and sensors, fixed respectively to the two side frames, measuring forces exerted by said displacement means on the said side frames, providing deformation compensation cylinders associated with one of the two beams, and an electronic control device for controlling the displacement of the movable beam between a top dead centre and a bottom dead centre, pre-recording a calibration diagram in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and applying pressures during a subsequent bending operation, to the said compensation cylinders corresponding to the forces measured at the said sensors according to said diagram.

2. The method according to claim 1, and further comprising the step of making a correction to a depth of penetration of the punch into the die by recalculating a bottom dead centre of the press according to characteristics of a piece to be bent and values measured by the sensors fixed to the side frames.

3. A method of correcting a bending operation performed by a press brake comprising the steps of providing two side frames integral with a fixed beam, a movable beam, and with displacement means for displacing the movable beam resting on said two side frames, and sensors, fixed respectively to the two side frames, measuring forces exerted by said displacement means on the said side frames, providing deformation compensation cylinders associated with one of the two beams, and an electronic control device for controlling the displacement of the movable beam between a top dead centre and a bottom dead centre, pre-recording a calibration diagram in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and applying pressures during a subsequent bending operation to the said compensation cylinders corresponding to the forces measured at the said sensors according to said diagram, making a correction to a depth of penetration of the punch into the die by recalculating a bottom dead centre of the press according to characteristics of a piece to be bent and values measured by the sensors fixed to the side frames, and applying the foregoing steps to a short piece to be bent, wherein a correction to the bottom dead centre is calculated by means of the formula $$\Delta Z=(F.l^2_a l^2_b)/(3.E.I.l)$$

in which:

F is the local load on the short piece (in newtons)

l is the distance between the side frames $l_a$ and $l_b$ are the respective distances from the centre of the piece to the side frames E is the modulus of elasticity of the top beam (in $N/mm^2$)

I is axial moment of inertia of the beam (in $mm^4$).

4. A method of correcting a bending operation performed by a press brake comprising the steps of providing two side frames integral with a fixed beam, a movable beam, and with displacement means for displacing the movable beam resting on said two side frames, and sensors, fixed respectively to the two side frames, measuring forces exerted by said displacement means on the said side frames, providing deformation compensation cylinders associated with one of the two beams, and an electronic control device for controlling the displacement of the movable beam between a top dead centre and a bottom dead centre, pre-recording a calibration diagram in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and applying pressure during a subsequent bending operation, the said compensation cylinders pressures corresponding to the forces measured at the said sensors according to said diagram, making a correction to a depth of penetration of the punch into the die by recalculating a bottom dead centre of the press according to characteristics of a piece to be bent and values measured by the sensors fixed to the side frames, and applying the foregoing steps to a long piece to be bent, wherein a correction $\Delta Z'$ to the bottom dead centre is applied to the travel of the movable beam calculated by means of the formula $$\Delta Z'=(5.Q.l^4)/(384000.E.I)$$

in which:

Q designates the load per unit length on the piece (in N/m)

E is the modulus of elasticity of the top beam (in $N/mm^2$)

I is the axial moment of inertia of the beam (in $mm^4$).

5. The method according to claim 2, and further comprising the step of determining an actual length of the piece by comparing a force measured by the said force sensors with a corresponding data of a reference bending operation.

6. The method according to claim 2, and further comprising the step of predetermining corrections to the bottom dead centres of the movable beam according to a length of the piece and forces measured by the said force sensors, and pre-recorded in a memory of the said electronic control device.

7. The method according to claim 2, and further comprising the step of applying an additional correction to the bottom dead centre that is calculated after determination of an actual thickness of the piece to be bent.

8. The method according to claim 2, and further comprising the step of applying an additional correction to the bottom dead centre that is calculated in order to compensate for a spring-back effect.

9. A press brake comprising a fixed beam, a movable beam, two side frames integral with the fixed beam, displacement means for displacing the movable beam resting on said two side frames sensors, fixed respectively to the two side frames, measuring forces exerted by the said displacement means on the said side frames, deformation compensation cylinders associated with the bottom beam, and an electronic control device controlling a displacement of the movable beam between a top dead centre and a bottom dead centre, wherein the said electronic control device is programmed to control the displacement of the movable beam between the top dead centre and a bottom dead centre wherein a calibration diagram is pre-recorded in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and wherein, during a subsequent bending operation, are applied to the said compensation cylinders pressures corresponding to the forces measured at the said sensors according to said diagram.

10. A press brake comprising a fixed beam, a movable beam, two side frames integral with the fixed beam, displacement means for displacing the movable beam resting on said two side frames sensors, fixed respectively to the two side frames, measuring forces exerted by the said displacement means on the said side frames, deformation compensation cylinders associated with the bottom beam, and an electronic control device controlling a displacement of the movable beam between a top dead centre and a bottom dead centre, wherein the said electronic control device is programmed for controlling the displacement of the movable beam between a top dead centre and a bottom dead centre, wherein a calibration diagram is pre-recorded in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and wherein, during a subsequent bending operation, are applied to the said compensation cylinders pressures corresponding to the forces measured at the said sensors according to said diagram, and wherein a correction to a depth of penetration of the punch into the die is made by recalculating a bottom dead centre of the press according to characteristics of a piece to be bent and values measured by the sensors fixed to the side frames, wherein said method is applied to a short piece to be bent, and wherein a correction to the bottom dead centre is calculated by means of the formula $$\Delta Z=(F.l^2_a.l^2_b)/(3.E.I.l)$$

in which:

F is the local load on the short piece (in newtons)

l is the distance between the side frames $l_a$ and $l_b$ are the respective distances from the centre of the piece to the side frames E is the modulus of elasticity of the top beam (in $N/mm^2$)

I is axial moment of inertia of the beam (in $mm^4$).

11. A press brake comprising a fixed beam, a movable beam, two side frames integral with the fixed beam, displacement means for displacing the movable beam resting on said two side frames sensors, fixed respectively to the two side frames, measuring forces exerted by the said displacement means on the said side frames, deformation compensation cylinders associated with the bottom beam, and an electronic control device controlling a displacement of the movable beam between a top dead centre and a bottom dead centre, wherein the said electronic control device is programmed for controlling the displacement of the movable beam between a top dead centre and a bottom dead centre, wherein a calibration diagram is pre-recorded in a memory of the electronic control device using calibration pieces of lengths shorter than 10% of the length between two said cylinders, the said diagram establishing a correspondence between forces measured by the sensors associated with the side frames and pressures that can be applied to said compensation cylinders of the beam carrying them, in order to keep the said beam substantially straight, and wherein, during a subsequent bending operation, are applied to the said compensation cylinders pressures corresponding to the forces measured at the said sensors according to said diagram, and wherein a correction to a depth of penetration of the punch into the die is made by recalculating a bottom dead centre of the press according to characteristics of a piece to be bent and values measured by the sensors fixed to the side frames, wherein said method is applied to a lone piece to be bent, and wherein a correction $\Delta Z'$ to the bottom dead centre is applied to the travel of the movable beam calculated by means of the formula $$\Delta Z'=(5.Q.l^4)/(384000.E.I)$$

in which:

Q designates the load per unit length on the piece (in N/m)

E is the modulus of elasticity of the top beam (in $N/mm^2$)

I is the axial moment of inertia of the beam (in $mm^4$).

12. The method according to claim 3, and further comprising the step of determining an actual length of the piece by comparing a force measured by the said force sensors with a corresponding data of a reference bending operation.

13. The method according to claim 3, and further comprising the step of determining corrections to the bottom dead centres of the movable beam according to a length of the piece and forces measured by the said force sensors, and pre-recorded in a memory of the said electronic control device.

14. The method according to claim 3, and further comprising the step of calculating an additional correction to the bottom dead centre after determination of an actual thickness of the piece to be bent.

15. The method according to claim 3, and further comprising the step of calculating an additional correction to the bottom dead centre in order to compensate for a spring-back effect.

16. The method according to claim 4, and further comprising the step of determining an actual length of the piece by comparing a force measured by the said force sensors with a corresponding data of a reference bending operation.

17. The method according to claim 4, and further comprising the step of pre-determining corrections to the bottom dead centres of the movable beam according to a length of the piece and forces measured by the said force sensors, and pre-recorded in a memory of the said electronic control device.

18. The method according to claim 4, and further comprising the step of calculating an additional correction to the bottom dead centre after determination of an actual thickness of the piece to be bent.

19. The method according to claim 4, and further comprising the step of calculating an additional correction to the bottom dead centre in order to compensate for a spring-back effect.

* * * * *

UNITED STATES PATENT AND TRADEMARK OFFICE

CERTIFICATE OF CORRECTION

PATENT NO. : 7,503,200 B2
APPLICATION NO. : 10/546909
DATED : March 17, 2009
INVENTOR(S) : Gerrit Gerritsen et al.

It is certified that error appears in the above-identified patent and that said Letters Patent is hereby corrected as shown below:

Column 11, claim 11, line 43, delete “a lone piece” and insert in lieu thereof -- a long piece --.

Signed and Sealed this

Twelfth Day of May, 2009

JOHN DOLL
*Acting Director of the United States Patent and Trademark Office*